US011674315B2

(12) United States Patent
Iftissen

(10) Patent No.: US 11,674,315 B2
(45) Date of Patent: Jun. 13, 2023

(54) SEALING DEVICE FOR CONSTRUCTION, AND ASSOCIATED MANUFACTURING METHOD

(71) Applicant: RIKKSEN, Chalon sur Saone (FR)

(72) Inventor: M. Gérard Iftissen, Saint Martin d'Uriage (FR)

(73) Assignee: RIKKSEN, Chalon-sur-Saone (FR)

( * ) Notice: Subject to any disclaimer, the term of this patent is extended or adjusted under 35 U.S.C. 154(b) by 206 days.

(21) Appl. No.: 17/174,192

(22) Filed: Feb. 11, 2021

(65) Prior Publication Data

US 2021/0246660 A1 Aug. 12, 2021

(30) Foreign Application Priority Data

Feb. 12, 2020 (FR) ..... 2001375

(51) Int. Cl.
*B21D 19/08* (2006.01)
*E04D 13/14* (2006.01)
*E04D 13/04* (2006.01)

(52) U.S. Cl.
CPC ..... *E04D 13/1407* (2013.01); *B21D 19/08* (2013.01); *E04D 13/0409* (2013.01); *E04D 2013/0436* (2013.01)

(58) Field of Classification Search
CPC ..... E04D 13/1407; E04D 13/0409; E04D 2013/0436; B21D 19/08; B21D 17/025; B21D 39/06; F16B 17/006
See application file for complete search history.

(56) References Cited

U.S. PATENT DOCUMENTS 4,130,932 A 12/1978 Epmeier
9,903,402 B2 * 2/2018 Faguer ..... F16B 19/10

FOREIGN PATENT DOCUMENTS

CH 276204 A 6/1951
DE 102013009847 A1 * 12/2013 ..... B21D 39/06
FR 3072107 A1 4/2019
JP S545859 A 1/1979
JP 2006175455 A 7/2006
WO 2014135772 A1 9/2014

OTHER PUBLICATIONS

Ducreuzot P, DE-102013009847-A1, Machine Translation, (Year: 2013).*
Preliminary Search Report dated Nov. 4, 2020, issued in corresponding French Application No. FR 2001375, filed Feb. 12, 2020, 9 pages.

* cited by examiner

*Primary Examiner* — Lee A Holly
(74) *Attorney, Agent, or Firm* — Christensen O'Connor Johnson Kindness PLLC

(57) ABSTRACT

The sealing device for construction comprises a duct and a linking member mounted around and rigidly connected to the duct, wherein the duct comprises:

an axial main portion around which the linking member is mounted, a radial bead formed on the main portion and extending radially outwards, and a distal end portion extending the main portion radially outwards and which is axially facing the bead to form therebetween an outwardly radially open annular mounting slot, the distal end portion extending radially beyond the bead, the main portion, the distal end portion and the bead of the duct being made of one piece, the linking member being mounted in the mounting slot and gripped axially between the bead and the distal end portion of the duct.

16 Claims, 13 Drawing Sheets

SEALING DEVICE FOR CONSTRUCTION, AND ASSOCIATED MANUFACTURING METHOD

CROSS-REFERENCE TO RELATED APPLICATION

This application claims the benefit of French Application No. FR 2001375, filed Feb. 12, 2020, the disclosure of which is hereby expressly incorporated by reference in its entirety.

BACKGROUND

Roofs of buildings, particularly flat roof slabs, have through passages which are provided for the flow of rainwater or the passage of chimney stacks. The flow or chimney stack ducts must be tightly connected to the seals arranged on the slabs.

The patent EP-B1-1 710 365 describes a sealing device which comprises a duct provided at one end with a flexible radial membrane. The membrane has an axial annular portion engaged between an end portion of the duct and an internal mounting ring.

This sealing device has the major disadvantage of requiring the use of a mounted internal mounting ring.

Such a mounted ring solution has drawbacks particularly in terms of tightness and mechanical strength.

The present invention aims to remedy these drawbacks.

SUMMARY

The present disclosure relates to a sealing device for construction, in particular for a roof, and a method for the manufacture thereof.

The disclosure relates to a sealing device for building or construction comprising a duct and a linking member mounted around and rigidly connected to the duct.

According to a general feature, the duct comprises an axial main portion around which the linking member is mounted, a radial bead formed on the main portion and extending radially outwards, and a distal end portion extending the main portion radially outwards and which is axially facing the bead to form an outwardly radially open annular mounting slot. The distal end portion extends radially beyond the bead.

According to a further general feature, the main portion, the distal end portion and the bead of the duct are made in one piece.

According to a further general feature, the linking member is mounted in the mounting slot and gripped axially between the bead and the distal end portion of the duct.

According to a further general feature, the distal end portion of the duct comprises at least one local deformation extending on the side of the linking member and engaged in said linking member.

The disclosure also relates to a method for manufacturing a sealing device for construction comprising a duct and a linking member, the method comprising the following steps:

- a step of mounting the linking member around the duct,
- a step of deforming an axial main portion of the duct to form at least in part a radial bead extending radially outwards,
- a step of bending a distal end portion of the duct towards the bead to form therebetween at least in part an outwardly radially open annular mounting slot and inside which the linking member is located in part, and

- a step of axial compression of the distal end portion and of the bead of the main portion of the duct to axially crimp therebetween the linking member inside the mounting slot. The distal end portion of the duct extends radially beyond the bead.

The method also comprises a step of deforming the distal end portion of the duct to form at least one local deformation extending on the side of the linking member and engaged in said linking member.

The step of mounting the linking member around the duct can be carried out before the step of deforming the main portion of the duct to form at least in part the bead, or alternatively after this deformation step.

The disclosure further relates to a further method for manufacturing a sealing device for construction comprising a duct and a linking member, the method comprising the following steps:

- a step of mounting the linking member around the duct provided with a preformed radial bead,
- a step of bending a distal end portion of the duct towards the preformed radial bead to form therebetween at least in part an outwardly radially open annular mounting slot and inside which the linking member is located in part, and
- a step of axial compression of the distal end portion and of the preformed radial bead of the main portion of the duct to axially crimp therebetween the linking member inside the mounting slot. The distal end portion of the duct extends radially beyond the bead.

The method also comprises a step of deforming the distal end portion of the duct to form at least one local deformation extending on the side of the linking member and engaged in said linking member.

In a specific implementation, the method further comprises, simultaneously with the step of bending the distal end portion of the main portion, a step of radial deformation of the bead of the duct. The step of bending the distal end portion of the duct can comprise a first phase during which only the distal end portion is deformed by bending towards the bead, and a second successive phase during which the bending of the distal end portion towards the bead continues and during which the step of radial deformation of the bead of the duct is simultaneously carried out.

In a specific implementation, the method comprises, during the step of mounting the linking member around the duct, mounting around said duct of a plate and a reinforcement plate axially below the plate.

In a specific embodiment, during the step of deforming the distal end portion of the duct, the free end of said distal end portion is bent on the side of the linking member to form said local deformation.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
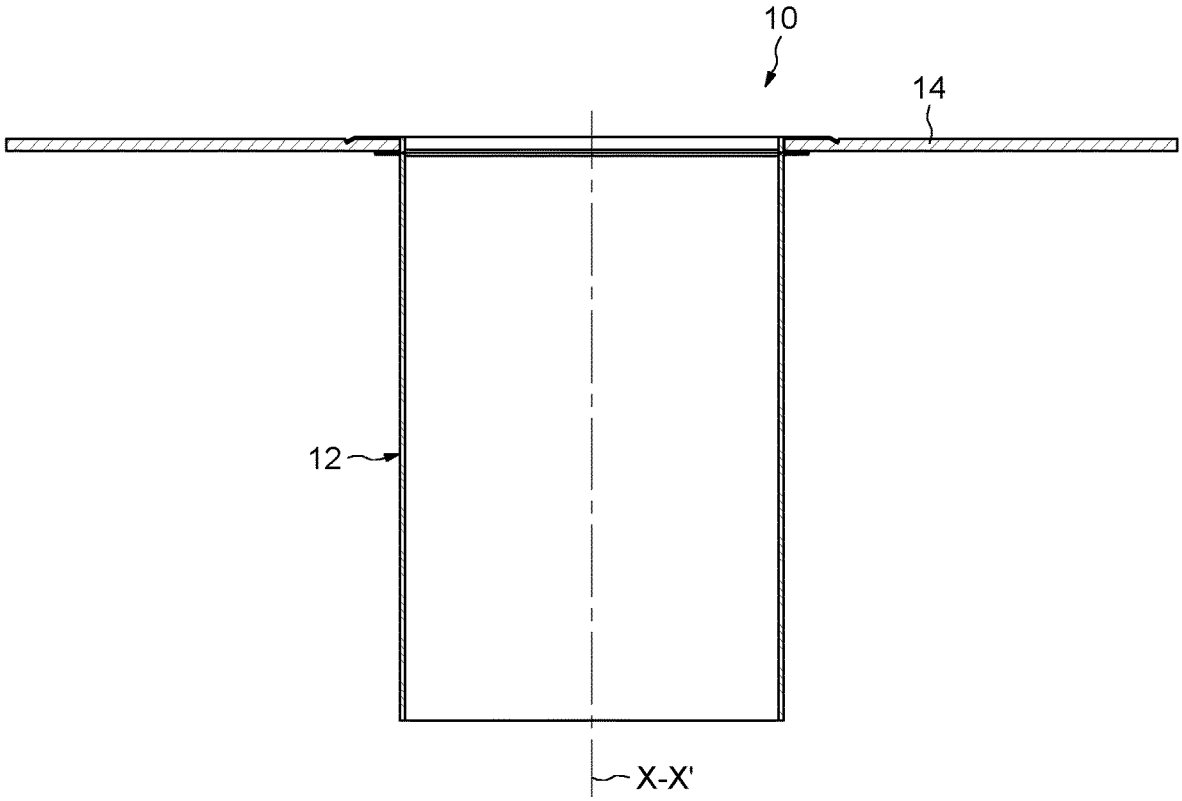
FIG. 1 is an axial sectional view of a sealing device according to a first embodiment example of the invention.

The present invention relates to a sealing device for construction, in particular for a roof, and a method for the manufacture thereof.

The invention relates to a sealing device for building or construction comprising a duct and a linking member mounted around and rigidly connected to the duct.

According to a general feature, the duct comprises an axial main portion around which the linking member is mounted, a radial bead formed on the main portion and extending radially outwards, and a distal end portion extending the main portion radially outwards and which is axially facing the bead to form an outwardly radially open annular mounting slot. The distal end portion extends radially beyond the bead.

According to a further general feature, the main portion, the distal end portion and the bead of the duct are made in one piece.

According to a further general feature, the linking member is mounted in the mounting slot and gripped axially between the bead and the distal end portion of the duct.

According to a further general feature, the distal end portion of the duct comprises at least one local deformation extending on the side of the linking member and engaged in said linking member.

Thus, the attachment of the linking member is obtained solely by the duct which is made in one piece. It is not necessary to arrange the use of additional and mounted parts to create this attachment of the linking member.

Providing a bead extending radially outwards makes it possible to obtain a sealing device which is robust and reliable over time by limiting the risk of the appearance of incipient fractures which can exist with a bead extending obliquely.

Furthermore, the embodiment of the distal end portion which extends radially beyond the bead makes it possible to limit the detachment thereof at the top when an external sealing layer is applied by heat welding on this distal end portion when the sealing device is installed on a roof slab.

The risk of water seepages between the distal portion of the duct and the linking member, as well as a tearing of this external sealing layer applied is thus limited.

Furthermore, the local deformation(s) arranged on the distal end portion of the duct carry out a function of locking the linking member which prevents the radial slippage thereof, particularly if the distal end portion starts to detach slightly when the external sealing layer is applied by heat welding. This limits the risk of water seepages further.

Moreover, the sealing device is manufactured with a small number of plastic deformation operations of the duct. Furthermore, given the radial orientation of the mounting slot, the linking member can have a simple, for example flat, shape.

Said local deformation of the distal end portion of the duct can for example be offset radially outwards with respect to the bead.

Said local deformation of the distal end portion of the duct is advantageously engaged in a complementary recess of the linking member. This recess can be obtained by deformation of the linking member itself formed by said local deformation of the distal end portion of the duct.

In an embodiment, the free end of the distal end portion of the duct is bent on the side of the linking member and forms said local deformation.

Alternatively or in combination, it could be possible to provide other types of local deformation(s) engaged in the linking member, for example ribs or axial beads. Such beads can be located on the distal portion of the duct so as to be outwardly offset with respect to the bead or be formed on the zone of the distal portion located in the axial extension of the bead.

Preferably, said local deformation of the distal end portion of the duct is annular. This favors obtaining securing on the linking member further. Alternatively, the distal end portion of the duct could comprise a plurality of deformations spaced apart from one another in the circumferential direction.

Advantageously, the radial dimension of the distal end portion of the duct is at least equal to one and a half times the radial dimension of the bead. Such a dimensioning limits the risk of detachment at the top of the distal end portion of the duct during the application of the external sealing layer. The radial dimension of the distal end portion of the duct can be at least equal to twice the radial dimension of the bead.

Preferably, the linking member is gripped axially between the bead and the distal end portion of the duct on at least one annular radial zone. This favors obtaining good tightness between the linking member and the duct further.

In an embodiment, the bead is formed by a proximal portion and by an intermediate portion of the main portion which are interconnected by an annular bend, the intermediate portion being axially facing the distal end portion and located axially between the distal portion and the proximal portion. The annular mounting slot can then be formed between the distal end portion and the intermediate portion of the bead.

The linking member comprises a plate. In a specific embodiment, the linking member further comprises a reinforcement plate mounted around the main portion of the duct and engaged in the mounting slot, the reinforcement plate being gripped axially between the bead of the duct and the plate.

The disclosure also relates to a method for manufacturing a sealing device for construction comprising a duct and a linking member, the method comprising the following steps:

- a step of mounting the linking member around the duct,
- a step of deforming an axial main portion of the duct to form at least in part a radial bead extending radially outwards,
- a step of bending a distal end portion of the duct towards the bead to form therebetween at least in part an outwardly radially open annular mounting slot and inside which the linking member is located in part, and
- a step of axial compression of the distal end portion and of the bead of the main portion of the duct to axially crimp therebetween the linking member inside the mounting slot. The distal end portion of the duct extends radially beyond the bead.

The method also comprises a step of deforming the distal end portion of the duct to form at least one local deformation extending on the side of the linking member and engaged in said linking member.

The step of mounting the linking member around the duct can be carried out before the step of deforming the main portion of the duct to form at least in part the bead, or alternatively after this deformation step.

The disclosure further relates to a further method for manufacturing a sealing device for construction comprising a duct and a linking member, the method comprising the following steps:

- a step of mounting the linking member around the duct provided with a preformed radial bead,
- a step of bending a distal end portion of the duct towards the preformed radial bead to form therebetween at least in part an outwardly radially open annular mounting slot and inside which the linking member is located in part, and
- a step of axial compression of the distal end portion and of the preformed radial bead of the main portion of the duct to axially crimp therebetween the linking member inside the mounting slot. The distal end portion of the duct extends radially beyond the bead.

The method also comprises a step of deforming the distal end portion of the duct to form at least one local deformation extending on the side of the linking member and engaged in said linking member.

In a specific implementation, the method further comprises, simultaneously with the step of bending the distal end portion of the main portion, a step of radial deformation of the bead of the duct. The step of bending the distal end portion of the duct can comprise a first phase during which only the distal end portion is deformed by bending towards the bead, and a second successive phase during which the bending of the distal end portion towards the bead continues and during which the step of radial deformation of the bead of the duct is simultaneously carried out.

In a specific implementation, the method comprises, during the step of mounting the linking member around the duct, mounting around said duct of a plate and a reinforcement plate axially below the plate.

In a specific embodiment, during the step of deforming the distal end portion of the duct, the free end of said distal end portion is bent on the side of the linking member to form said local deformation.

Figure 2:
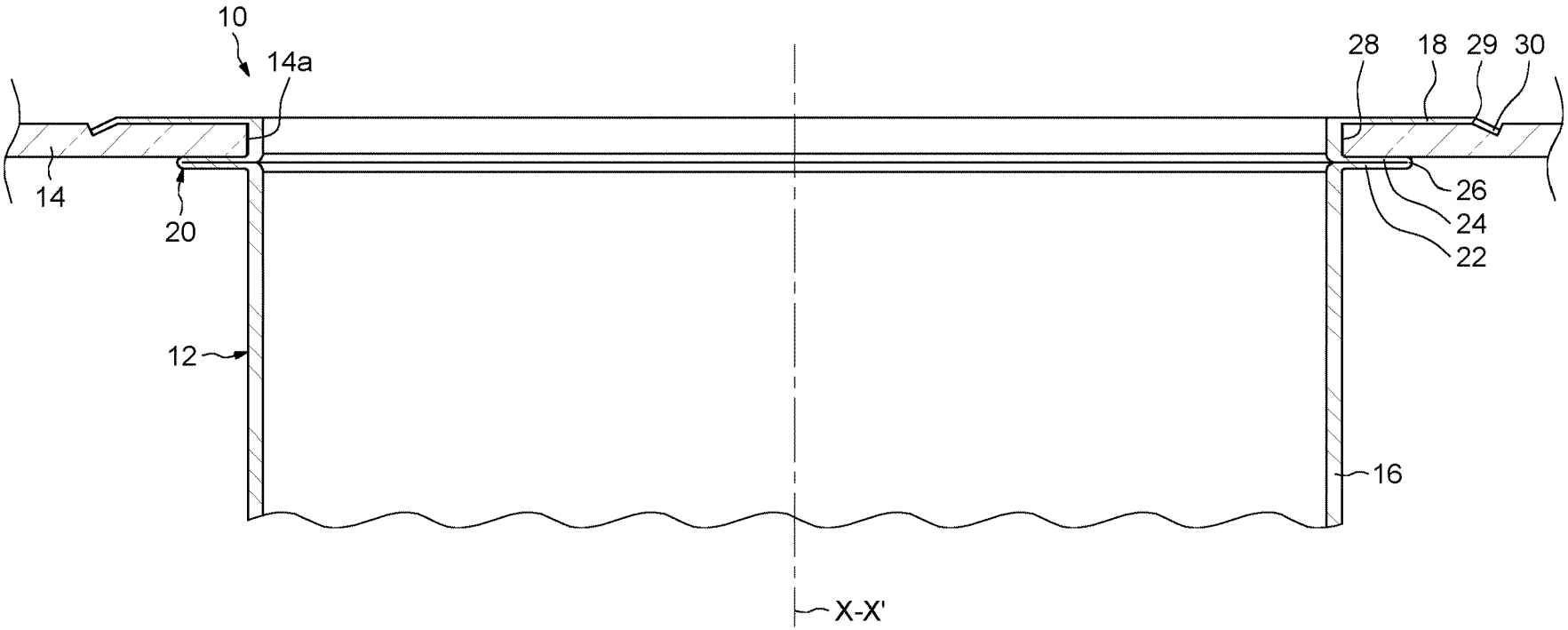
FIG. 2 is a detailed view of FIG. 1.

FIGS. 1 and 2 represent a sealing device, referenced 10 as a whole which comprises a duct 12, of axis X-X', and a linking plate 14 rigidly connected to the duct. The device 10 is represented in an assumed vertical position.

The duct 12 successively comprises an annular axial main portion 16 and an annular radial distal end portion 18. The distal portion 18 delimits the free end of the duct 12. The distal portion 18 extends the main portion 16 radially outwards. The distal portion 18 extends the upper end of the main portion 16. The main portion 16 of the duct is here of cylindrical shape. Alternatively, it could be possible to have a main portion 16 having in a cross-section a shape other than circular, for example polygonal.

The duct 12 also comprises an annular bead 20 formed on the main portion 16 axially at a distance from the distal portion 18. The bead 20 extends radially outwards with respect to the main portion 16. The distal portion 18 extends radially beyond the bead 20. Preferably, the radial dimension of the distal portion 18 is at least equal to one and a half times the radial dimension of the bead 20, and even more preferably at least equal to twice the radial dimension of the bead 20.

The bead 20 is formed by an annular proximal portion 22 and by an annular intermediate portion 24 of the main portion 16. The proximal 22 and intermediate 24 portions each extend radially outwards with respect to the main portion 16. The proximal 22 and intermediate 24 portions are interconnected by an annular fold or bend 26. The bend 26 has a concave shape oriented radially inwards.

The proximal 22 and intermediate 24 portions of the bead are axially facing and axially in contact against one another. The intermediate portion 24 is located axially between the proximal portion 22 and the distal portion 18. The intermediate portion 24 is axially facing the distal end portion 18 while being axially at a distance therefrom.

The distal portion 18 of the duct and the intermediate portion 24 of the bead 20 form therebetween an outwardly radially open annular mounting slot 28. The main portion 16 forms the annular bottom of the slot 28 which is hence blind. In the embodiment example illustrated, the slot 28 has a radially oriented U-shaped cross-section.

The duct 12 is made of one piece, i.e. the main portion 18, the distal portion 20 and the bead 20 are integral, i.e. one-piece.

The linking plate 14 is provided with a through opening 14*a* for the mounting thereof on the duct 12. The plate 14 is mounted around the main portion 16 of the duct. The internal diameter of the opening 14*a* is greater than the external diameter of the main portion 16. The plate 14 is engaged in the slot 28 formed between the distal portion 18 and the bead 20. The plate 14 is engaged or gripped axially in the slot 28 between the distal portion 18 and the bead 20. This enables the connection of the plate 14 to the duct 12. The two opposite radial faces of the plate 14 defining the thickness thereof are in contact against the distal portion 18 and against the intermediate portion 24 of the bead. The plate 14 is gripped axially inside the slot 28 between the distal portion 18 and the intermediate portion 24 of the bead. The plate 14 extends radially projecting out of the slot 28.

The annular free end part 29 of the distal portion 18 of the duct is bent on the side of the plate 14 and is engaged in the plate 14. The free end part 29 extends here obliquely on the side of the plate 14. An annular bend 30 is formed between the free end part 29 of the distal portion 18 and the rest of the distal portion 18 which extends radially.

The annular free end part 29 of the distal portion 18 is engaged in the plate 14 by locally deforming the plate, in this case by locally deforming the radial face of the plate 14 in contact against the distal portion 18. A complementary recess (not referenced) is formed on this radial face inside which the annular free end part 29 of the distal portion 18 is engaged. This recess is formed by local deformation of the radial face of the plate 14. The bend 30 forms a bend for stiffening the distal portion 18 of the duct. The free end part 29 forms a local deformation of the distal portion 18.

For example, the duct 12 can be made of metallic material, for example of galvanized sheet or aluminum, or of a plastic or of any other suitable material. The linking plate 14 can be made of an asphalted material, in the form of a flexible membrane, or of metallic material, for example of an embossed metal sheet, or of plastic or any other suitable material.

Figure 3:
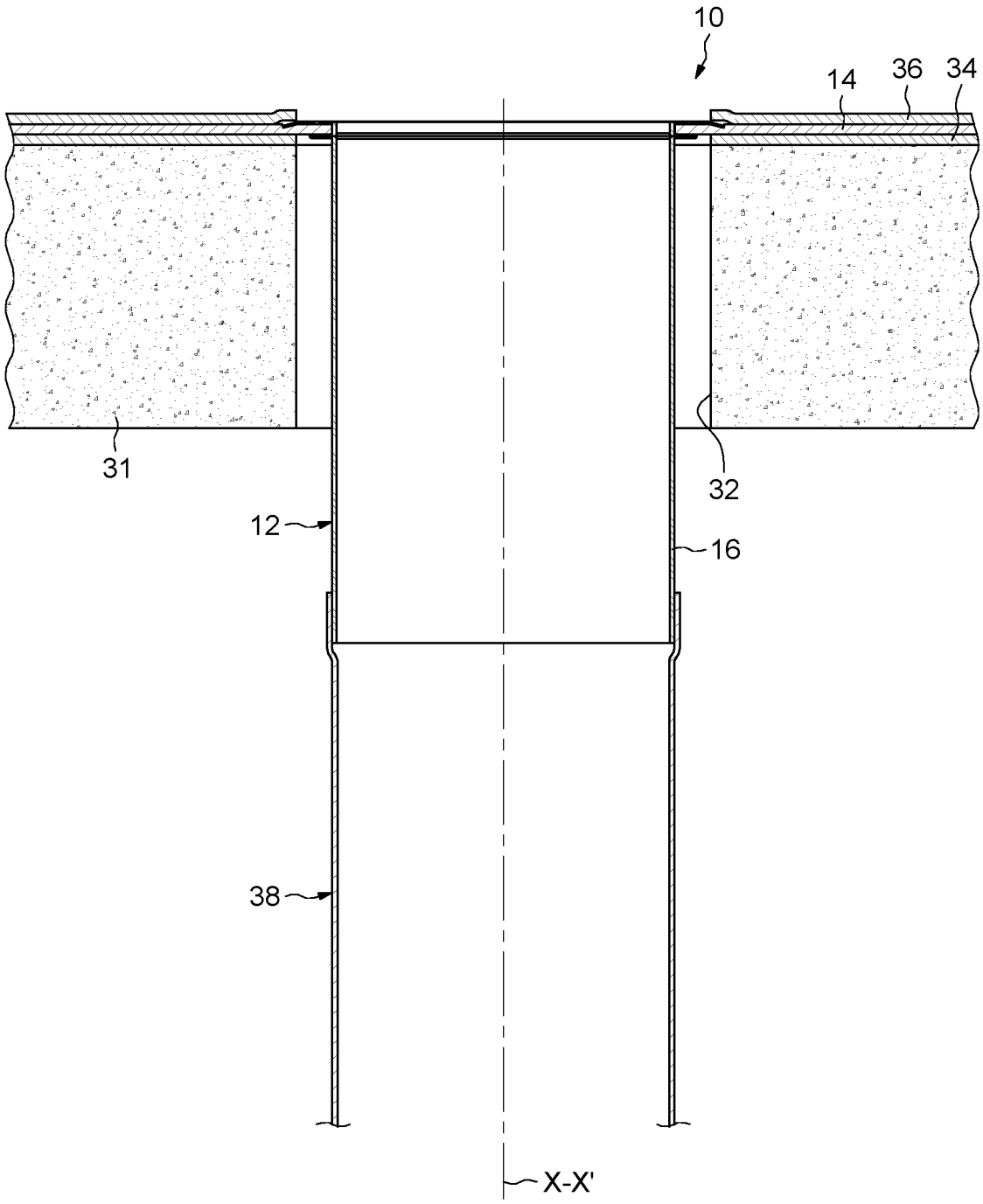
FIG. 3 is an axial sectional view of a mounting of the sealing device in FIG. 1 on a building slab.

According to a use illustrated in FIG. 3, the sealing device 10 can be installed on a slab 31 of a flat or sloping roof to form a tight connection, for example as follows.

A hole 32 being formed through the slab 31, a sealing underlayer 34 is deposited on the top face of the slab 31, until proximity with this hole 32.

The main portion 16 of the duct 12 is engaged axially downwards into the hole 32, until the plate 14 rests on the sealing underlayer 34 and adheres thereto.

Then, an external sealing layer 36 can be deposited on the underlayer 34 and on the plate 14, by leaving free access to the internal vertical passage delimited by the duct 12.

During or after installation, the lower end of the main portion 16 of the duct 12 is engaged in the upper end of an evacuation duct 38.

The underlayer 34 and the external sealing layer 36 are generally made of an asphalted material, installed hot. Thus, the sublayer 34 adheres to the slab 31, the external layer 36 adheres to the underlayer 34 and the plate 14 adheres to the both the underlayer 34 and to the external layer 36.

According to an alternative use, the sealing device 10 can be installed inverted, i.e. in a position such that the main portion 16 of the duct 12 extends upwards projecting upwards with respect to the slab 31, the plate 14 being fitted on the slab 31 between the sealing layers 34 and 36.

With reference to FIGS. 4 to 11, an example of implementation of the method for manufacturing the sealing device 10 for obtaining the duct 12 in one piece and connecting the plate 14 to the duct will now be described.

In this example of manufacture, a machine 40 equipped with an external securing plate 42 equipped with a shoulder 44 forming a stop for the lower end of the duct 12 is used. The plate 42 delimits a vertical passage 46 inside which the duct 12 is mounted. The passage 46 is equipped internally with an annular groove 48 which extends radially in the plate in the vicinity of a radial top face thereof. Alternatively, the groove 48 could open onto the top face of the plate.

Figure 4:
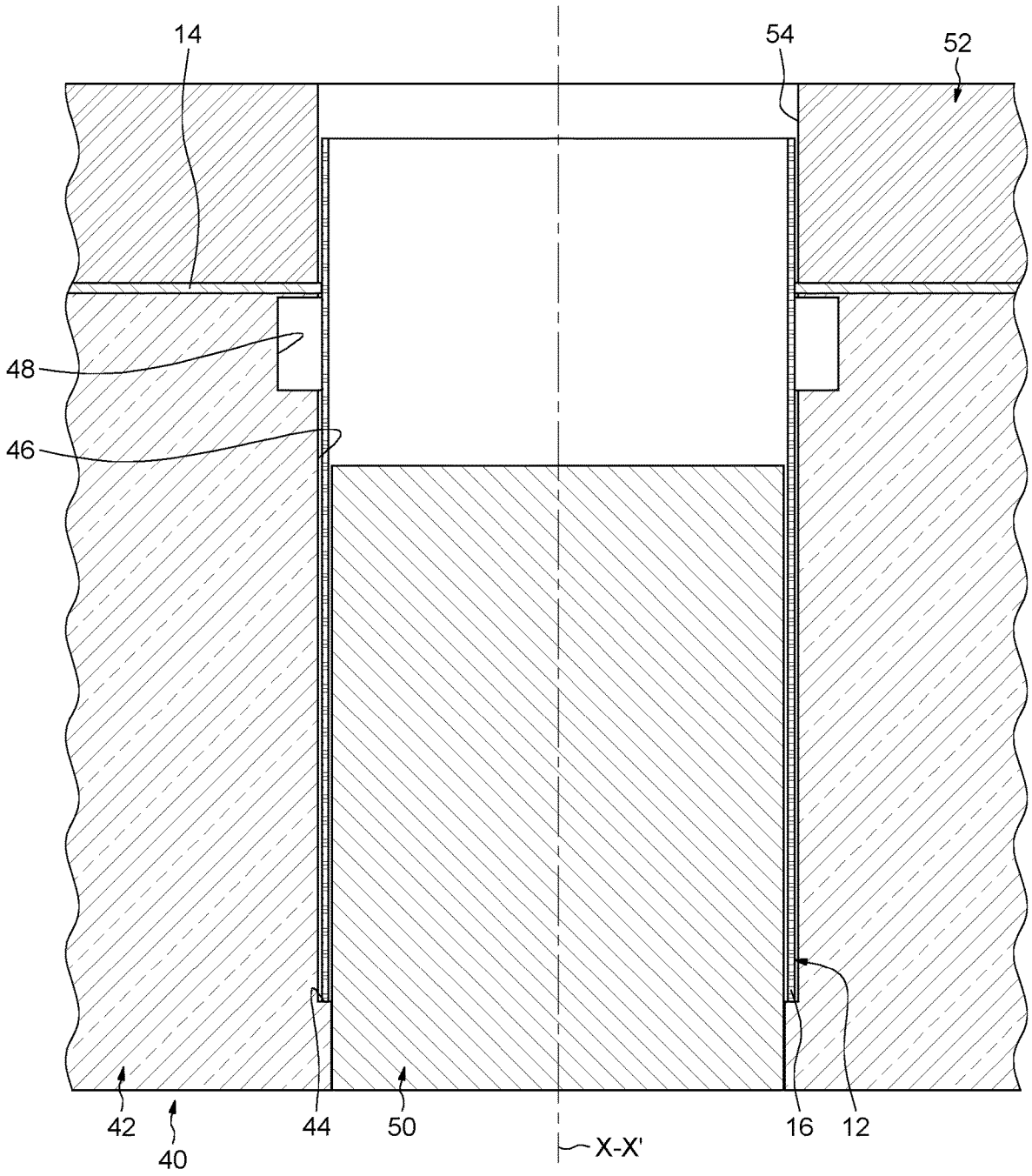
FIG. 4-FIG. 11 illustrate steps of manufacturing the sealing device in FIG. 1 according to an example of implementation of the invention.

In a first step of the method, the duct 12 is mounted onto the machine 40. As illustrated in FIG. 4, the duct 12 having a rectilinear shape from one end to the other is initially disposed, which is placed vertically through the passage 46 of the plate 42 and which is brought to bear against the shoulder 44. The duct 12 is engaged inside the passage 46 with a slight radial play.

The duct 12 is disposed in a vertical position such that it extends axially projecting with respect to the top face of the plate 42. During or before this step, the plate 14 is mounted with a radial play around the duct 12. The plate 14 comes axially to bear against the top face of the plate 42.

The machine 40 also comprises a cylindrical internal securing template 50 engaged inside the duct 12 with a slight radial play. The template 50 is located axially set back from the groove 48 of the plate.

Then, during this first step of the method, an upper securing plate 52 is brought axially to bear against the plate 14. The plate 52 delimits a vertical passage 54 inside which the part of the duct 12 projecting out of the plate 42 is mounted.

At this stage, the duct 12 is still formed solely of the main portion 16.

Figure 5:
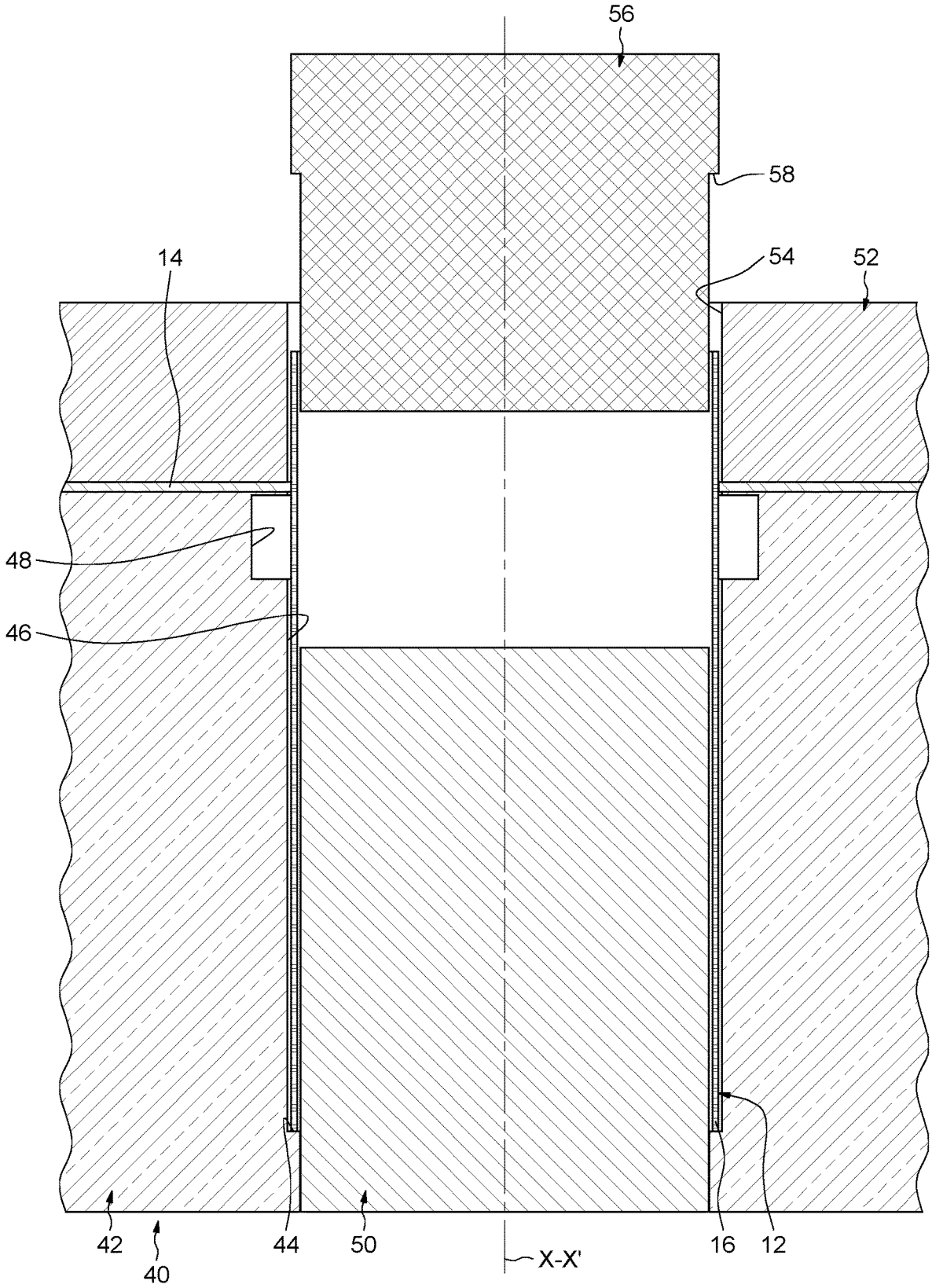

As illustrated in FIG. 5, the machine 40 also comprises a deformation tool or punch 56 which is provided externally with an annular shoulder 58.

In a second step of the method, the outward radial deformation of the main portion 16 of the duct 12 axially below the plate 14 is performed.

Figure 6:
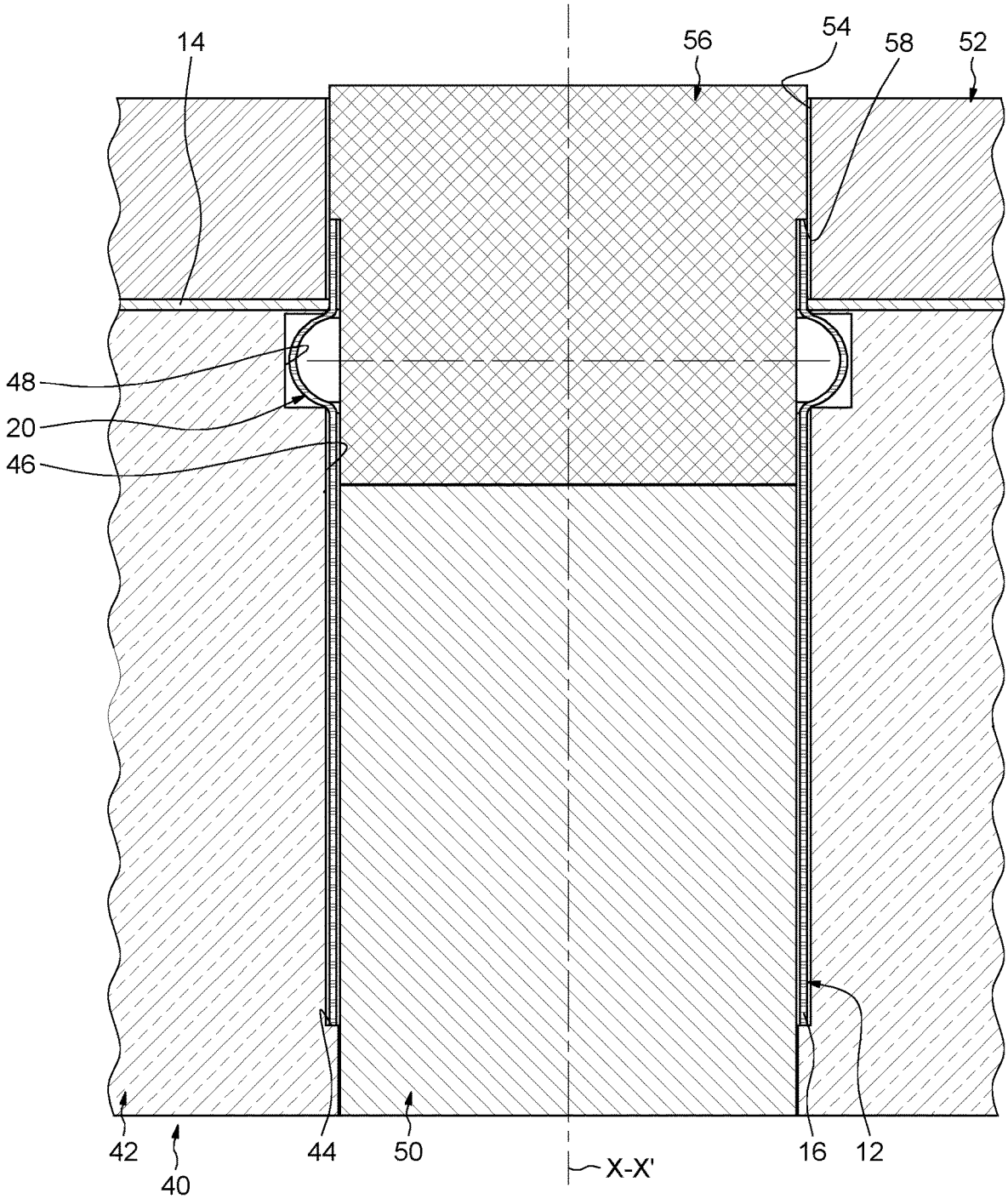

To do this, during this step, the punch 56 is inserted axially inside the plate 52 and inside the duct 12 with a radial play, then comes axially to bear against the upper end of the duct 12 by means of the shoulder 58 and continues to move axially until it comes to bear against the template 50 as illustrated in FIG. 6.

The axial force exerted by the punch 56 on the upper end of the duct 12 causes a locally radial outward deformation of the main portion 16 of the duct 12 inside the groove 48 of the plate 42.

This second step of the method makes it possible to preform the bead 20 on the main portion 16 of the duct.

Figure 7:
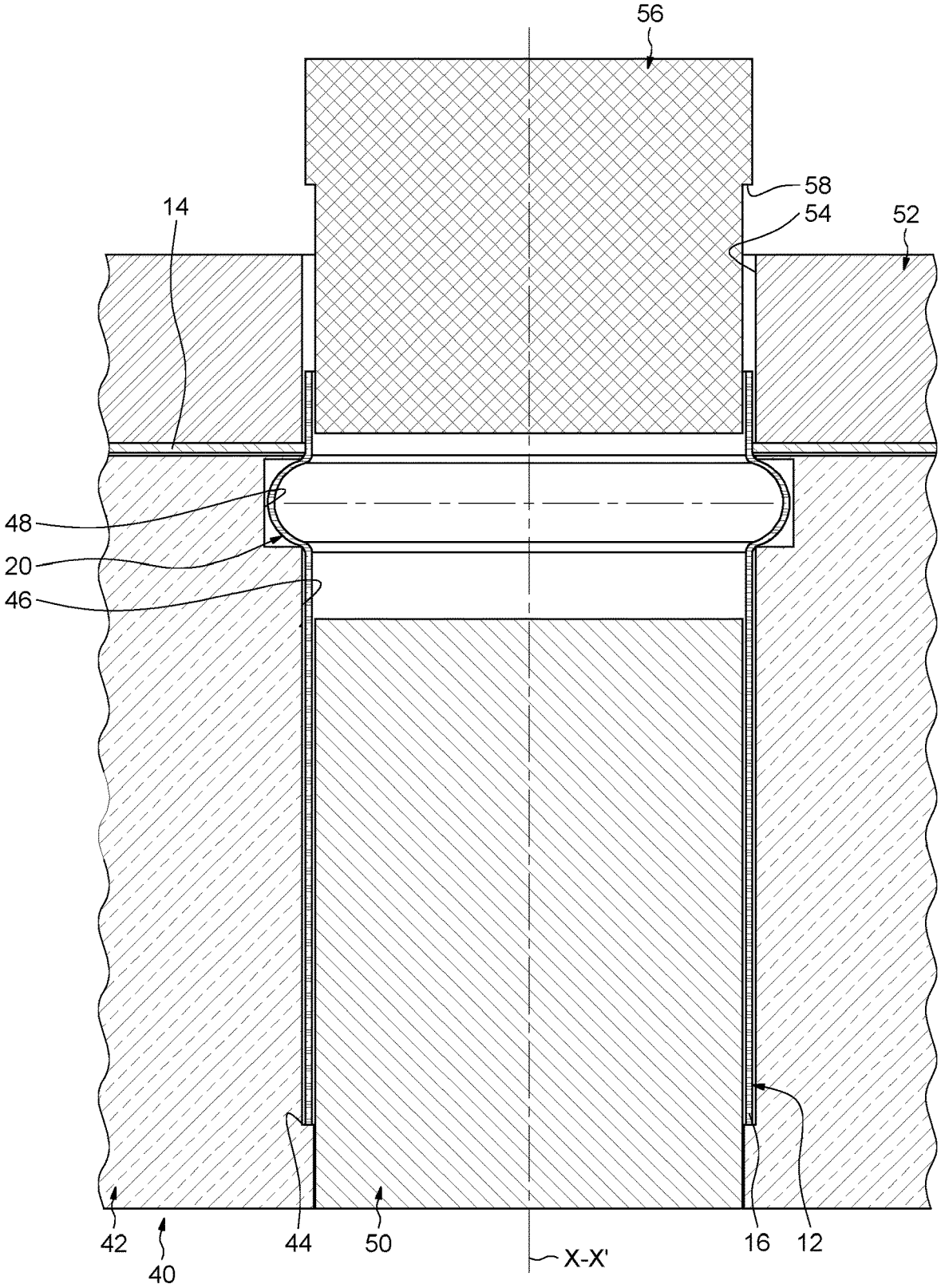

As illustrated in FIG. 7, the punch 56 is then extracted axially upwards out of the duct 12. Then, the template 50 is also removed.

Then, in a third step of the method, the part of the main portion 16 which is located axially above the preform of the bead 20 and the plate 14 is bent to preform the distal portion 18.

Figure 8:
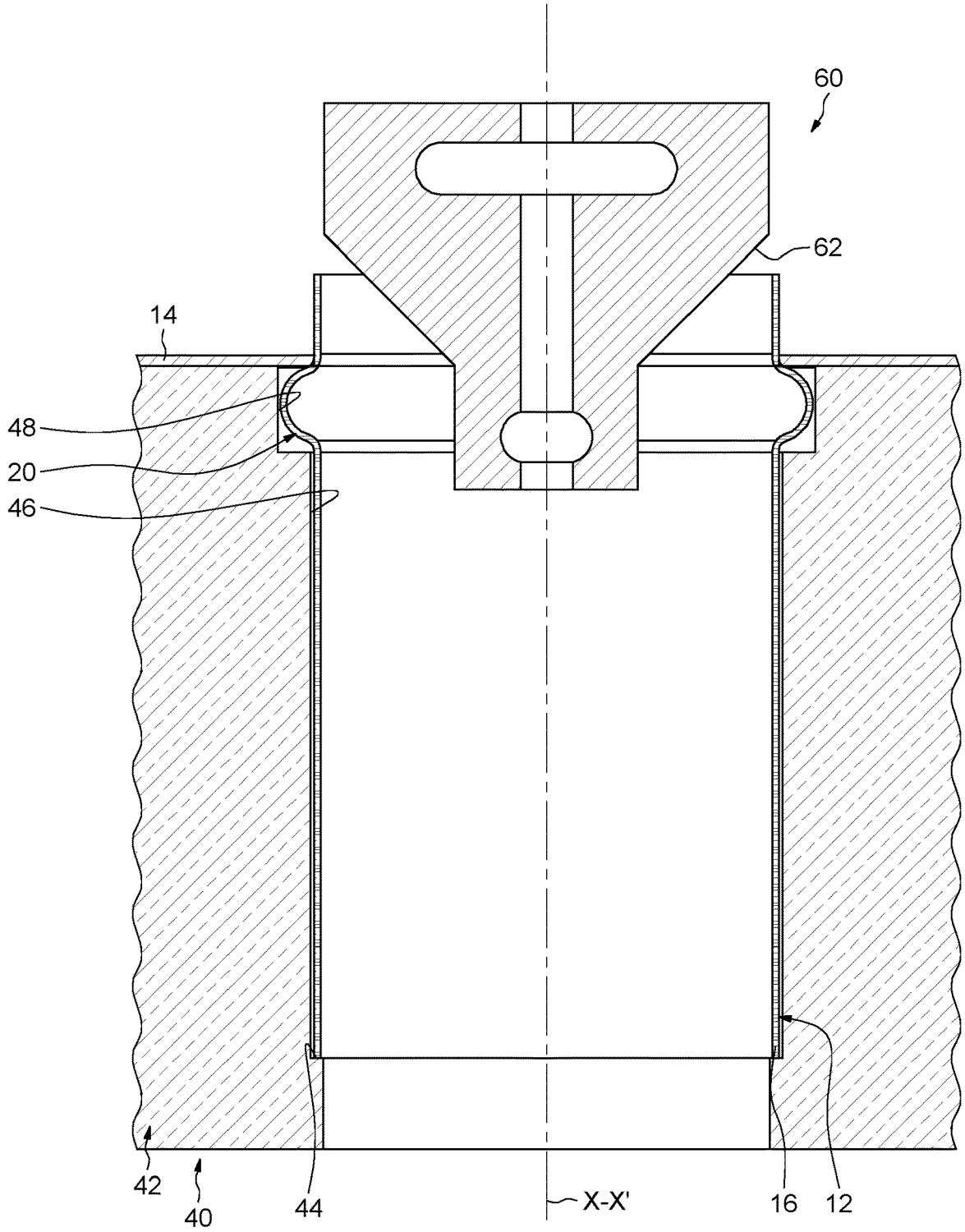

During a first phase of this third step, one starts by removing the plate 52 from the machine. Then, as illustrated in FIG. 8, a forming tool 60 of the machine which is provided externally with a frustoconical part 62 is brought axially inside the duct 12 until this frustoconical part is vertically at the height of the part of the main portion 16 which is located axially above the plate 14.

Figure 9:
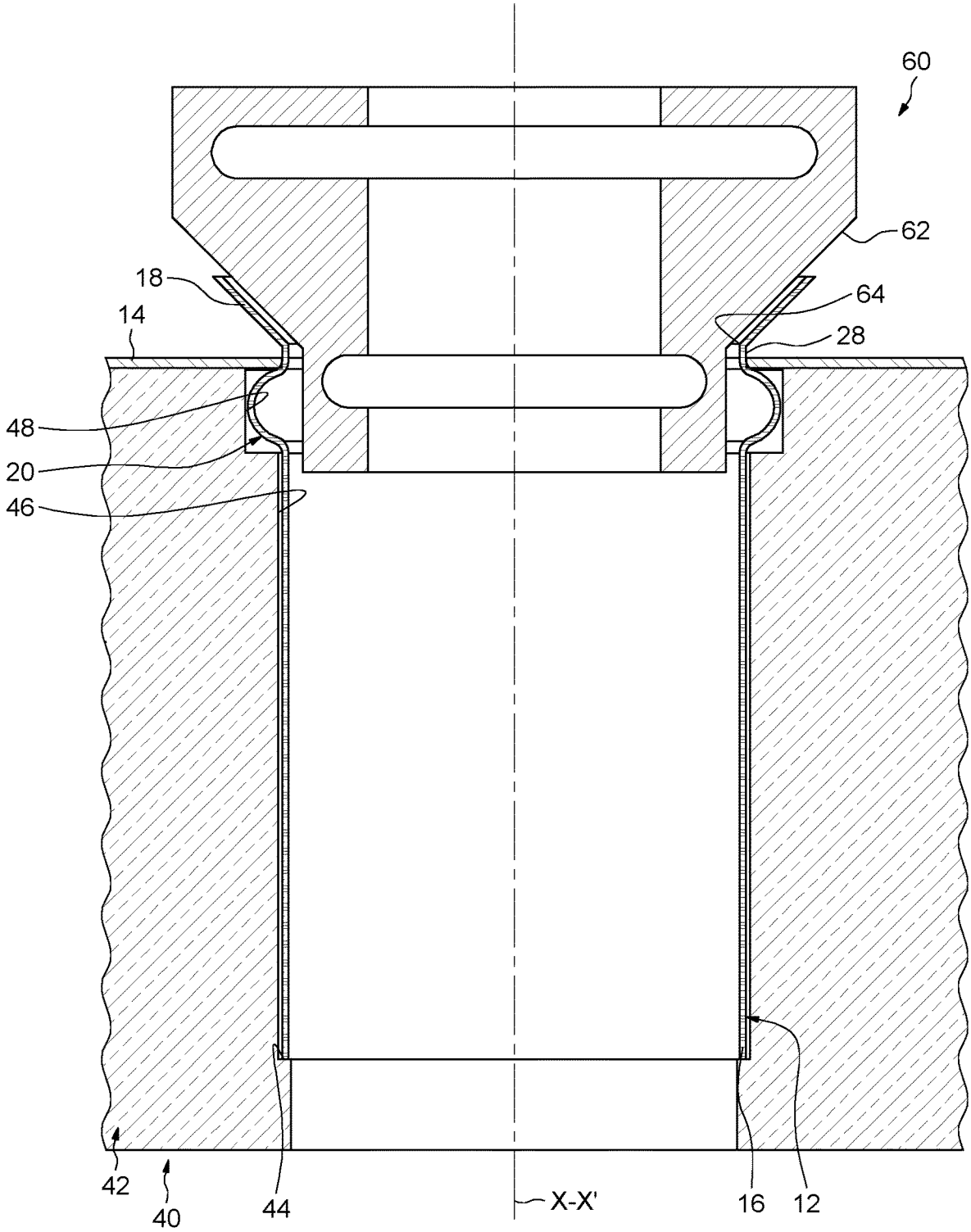

Then, as represented in FIG. 9, the forming tool 60 is actuated radially outwards in order to bend outwards the part of the main portion 16 which extends projecting axially above the plate 14 towards the preform of the bead 20 and the plate 14. This causes the formation of an annular plate 64 on the main portion 16 of the duct from which the preform of the distal portion 18 extends. At this stage, the preform of the distal portion 18 extends obliquely. Bending the preform of the distal portion 18 also makes it possible to preform the slot 28 between it and the preform of the bead 20.

When the forming tool 60 has reached a predetermined internal radial position, here in the vicinity of the bore of the duct 12, then it is returned to the initial position thereof before being extracted radially upwards.

Figure 10:
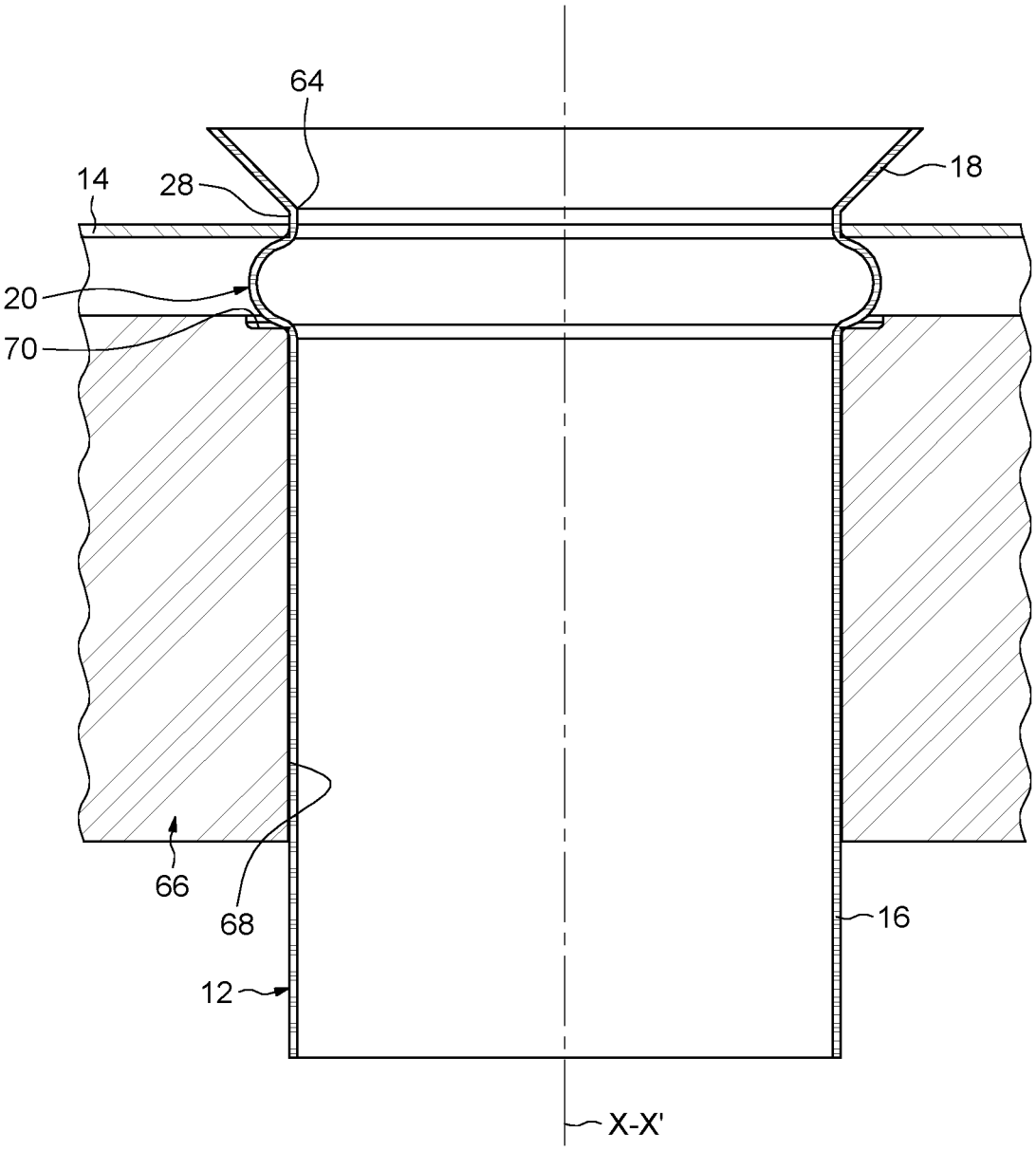
Figure 11:
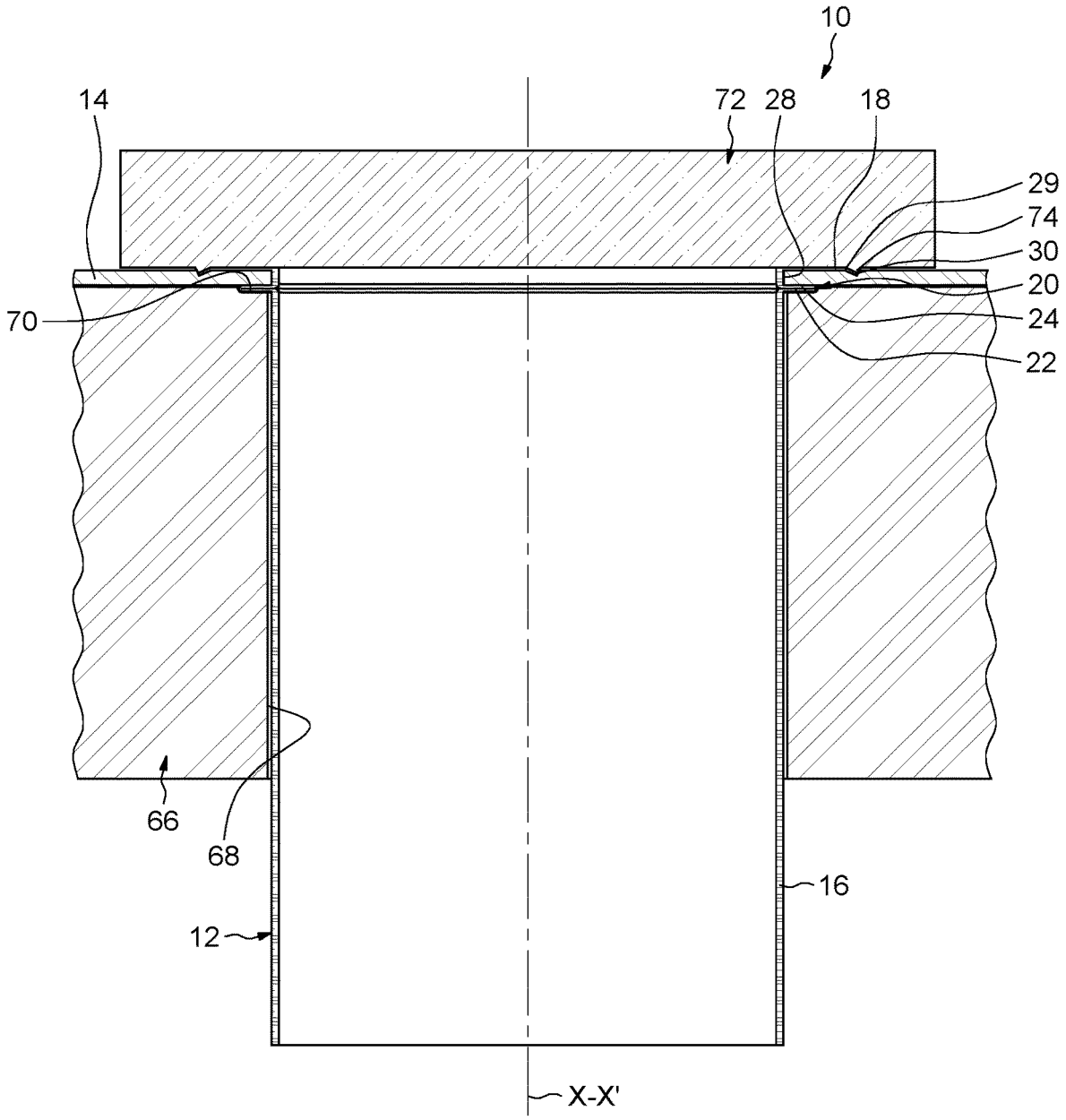

Then, in a second phase of the third step, the horizontal plate 42 is removed, and another horizontal plate 66 of the machine is used as illustrated in FIG. 10. The plate 66 is equipped with a vertical passage 68 through which the duct 12 extends with a slight radial play.

The passage 68 of the plate is equipped internally with an annular groove 70 which extends radially in the thickness of the plate and opens onto a radial top face thereof. The bore of the groove 70 is arranged to be slightly greater than the external diameter of the preform of the bead 20. This preform of the bead 20 comes axially to bear against the upper end of the passage 68 from which the groove 70 is formed. The plate 14 is located axially at a distance from the top face of the horizontal plate 66.

Then, in a fourth step of the method, a crimping tool 72 (FIGS. 11 and 12) comes axially to bear against the preform of the distal portion 18 of the duct, and is moved axially downwards to fold it down axially against the plate 14 and to compress axially, against the plate 66 which is kept fixed, the axial stack consisting of the distal portion 18 of the duct, the plate 14 and the bead 20 of the duct. The distal portion 18, the slot 28 and the bead 20 are definitively formed during this step of the method. During this fourth step, the proximal 22 and intermediate 24 portions of the bead come axially in contact with one another. The plate 14 is also gripped axially by axial compression in the slot 28 between the distal portion 18 and the bead 20 of the duct.

In doing so, the axial spacing between the distal portion 18 and the intermediate portion 24 of the bead is reduced and the plate 14 is gripped axially, tightly, between these two portions. This results in a crimping mounting of the plate 14 inside the slot 28 delimited by the distal portion 18 and the bead 20 of the duct is mounted by crimping the mounting is performed by crimping.

In this example of implementation, the crimping tool 72 comprises an annular frustoconical-shaped protuberance 74 to obtain simultaneously, on crimping the plate 14, the bending of the annular free end part 29 of the distal portion 18 of the side of the plate. The free end part 29 is engaged in the plate 14 by local deformation of said plate. The complementary recess to the free end part 29 is formed by this local deformation.

Finally, in a fifth and final step of the method, the crimping tool 72 and the plate 66 are removed, the sealing device 10 described and illustrated in FIG. 1 is obtained.

In the example of implementation of the method described above, the local deformation of the distal portion 18 of the duct to bend the free end part 29 is carried out simultaneously to the crimping of the plate 14 inside the slot 28 delimited between the distal portion 18 and the bead 20 of the duct. Alternatively, this step of local deformation by bending could be carried out following the step of axial crimping of the plate 14.

Moreover, in the example of implementation of the method described above, a single phase of bending the part of the main portion 16 which is located axially above the plate 14 to preform the distal portion 18 is arranged.

Alternatively, after the second phase of the third step, it is possible to arrange a second bending phase. In this case, a second forming tool of the machine which is provided externally with a frustoconical part, of greater conicity than that of the forming tool 60, comes to bear axially against the preform of the distal portion 18 of the duct to continue the bending thereof around the bend 64 previously formed and towards the preform of the bead 20. When this forming tool has achieved a predetermined axial position, then it is removed axially upward. During this second phase of the bending, the preform of the distal portion 18 of the duct furthermore extends obliquely upwards.

Simultaneously with this second phase of bending the preform of the distal portion 18, the duct 12 can be moved axially upwards towards the forming tool.

As stated above, the plate 14 forms a linking member for installing the device on the roof of a building. In this first example, the linking member is thus formed solely by the plate 14.

Figure 12:
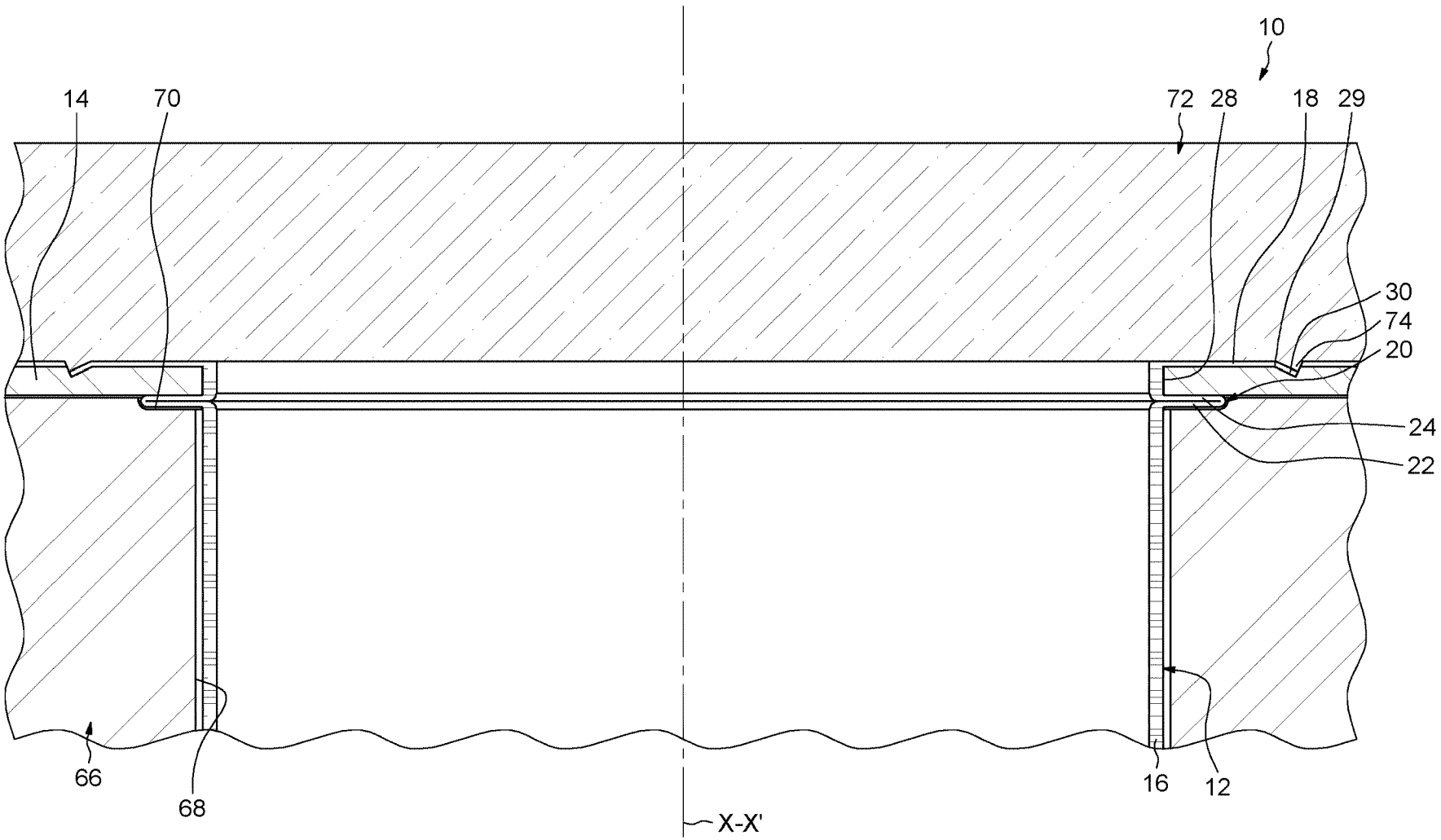
FIG. 12 is a detailed view of FIG. 11.
Figure 13:
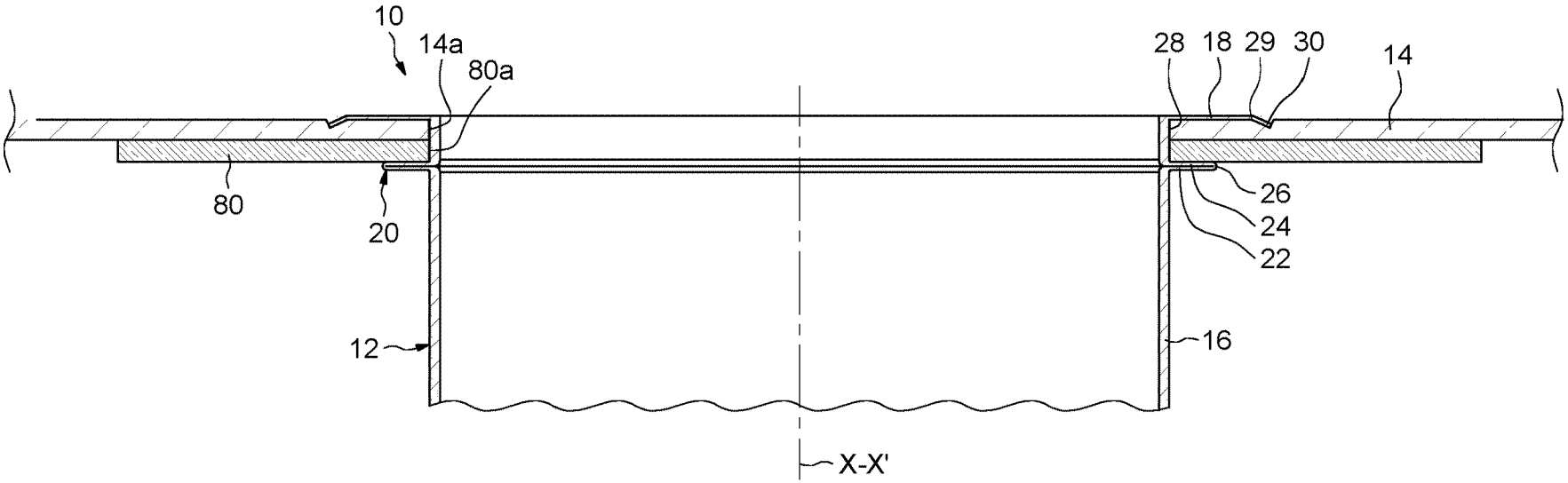
FIG. 13 is an axial sectional view of a sealing device according to a second embodiment example of the invention.

The embodiment example illustrated in FIG. 12, in which identical elements bear the same references, differs from the first example described in that the linking member further comprises a reinforcement plate 80 mounted around the axial portion 16 of the duct and engaged inside the slot 28 formed between the distal portion 18 and the bead 20 of the duct. In this second example, the linking member is therefore formed by the plate 14 and by the reinforcement plate 80.

The reinforcement plate 80 extends radially projecting out of the slot 28. The reinforcement plate 80 is provided with a through opening 80*a* for the mounting thereof on the duct 12. The reinforcement plate 80 is gripped axially between the plate 14 and the bead 20, more specifically the intermediate portion 24 thereof.

The same method as that described above can be implemented to obtain the device 10 of this second example, with a mounting of the reinforcement plate 80 on the duct 12 simultaneously with the mounting of the plate 14.

In the examples of implementation described above, the mounting on the duct 12 of the plate 14, or of the plate 14 and the reinforcement plate 80, is performed before the radial deformation of the main portion 16 of the duct which is carried out to preform the bead 20. Alternatively, it could be possible to arrange this mounting after radial deformation of the main portion 16 of the duct.

In a further alternative embodiment, it is also possible to carry out the mounting of the plate 14, or of the plate 14 and the reinforcement plate 80, on a duct provided with a preformed bead on a separate production site.

While illustrative embodiments have been illustrated and described, it will be appreciated that various changes can be made therein without departing from the spirit and scope of the invention.

The invention claimed is:

1. A sealing device for building comprising a duct and a linking member mounted around and rigidly connected to the duct, wherein the duct comprises:

an axial main portion around which the linking member is mounted, a radial bead formed on the main portion and extending radially outwards, and a distal end portion extending the main portion radially outwards and which is axially facing the bead to form therebetween an outwardly radially open annular mounting slot, the distal end portion extending radially beyond the bead, the main portion, the distal end portion and the bead of the duct being made in one piece, the linking member being mounted in the mounting slot and gripped axially between the bead and the distal end portion of the duct, the distal end portion of the duct comprising at least one local deformation extending on the side of the linking member and engaged in a complementary recess of the linking member.

2. The sealing device according to claim 1, wherein the linking member comprises a linking plate.

3. The sealing device according to claim 2, wherein the linking member further comprises a reinforcement plate mounted around the main portion of the duct and engaged in the mounting slot, the reinforcement plate being gripped axially between the bead of the duct and the linking plate.

4. The sealing device according to claim 1, wherein the local deformation of the distal end portion of the duct is offset radially outwards with respect to the bead.

5. The sealing device according to claim 1, wherein the free end of the distal end portion of the duct is bent on the side of the linking member and forms the local deformation.

6. The sealing device according to claim 1, wherein the local deformation of the distal end portion of the duct is annular.

7. The sealing device according to claim 1, wherein the radial dimension of the distal end portion of the duct is at least equal to one and a half times the radial dimension of the bead.

8. The sealing device according to claim 1, wherein the linking member is gripped axially between the bead and the distal end portion of the duct on at least one annular radial zone.

9. The sealing device according claim 1, wherein the bead is formed by a proximal portion and by an intermediate portion of the main portion which are interconnected by an annular bend, the intermediate portion being axially facing the distal end portion and located axially between the distal portion and the proximal portion.

10. A method for manufacturing a sealing device for construction comprising a duct and a linking member, the method comprising the following steps:

a step of mounting the linking member around the duct, a step of deforming an axial main portion of the duct to form at least in part a radial bead extending radially outwards, a step of bending a distal end portion of the duct towards the bead to form therebetween at least in part an outwardly radially open annular mounting slot and inside which the linking member is located in part, and a step of axial compression of the distal end portion and of the bead of the duct to axially crimp therebetween the linking member inside the mounting slot, the distal end portion extending radially beyond the bead, and a step of local deformation of the distal end portion of the duct to form at least one deformation extending on the side of the linking member and engaged in a complementary recess of the linking member.

11. The method according to claim 10, wherein the step of mounting the linking member around the duct is carried out before the step of deforming the main portion of the duct to form at least in part the bead.

12. The method according to claim 10, further comprising, simultaneously with the step of bending the distal end portion of the duct, a step of radial deformation of the bead of the duct.

13. The method according to claim 10, wherein, during the step of deforming the distal end portion of the duct, the free end of the distal end portion is bent on the side of the linking member to form the local deformation.

14. A method for manufacturing a sealing device for construction comprising a duct and a linking member, the method comprising the following steps:

a step of mounting the linking member around the duct provided with a preformed radial bead, a step of bending a distal end portion of the duct towards the preformed radial bead to form therebetween at least in part an outwardly radially open annular mounting slot and inside which the linking member is located in part, a step of axial compression of the distal end portion and of the preformed radial bead of the duct to axially crimp therebetween the linking member inside the mounting slot, the distal end portion extending radially beyond the bead, and a step of local deformation of the distal end portion of the duct to form at least one deformation extending on the side of the linking member and engaged in the linking member.

15. The method according to claim 14, further comprising, simultaneously with the step of bending the distal end portion of the duct, a step of radial deformation of the bead of the duct.

16. The method according to claim 14, wherein, during the step of deforming the distal end portion of the duct, the free end of the distal end portion is bent on the side of the linking member to form the local deformation.

* * * * *